United States Patent [19]

Szigeti

[11] 4,329,376

[45] May 11, 1982

[54] METHOD FOR STABILIZING THE TEXTURE OF A PLASTIC SUBSTANCE

[76] Inventor: Elemer Szigeti, 1 Place Eugene Mo, Nice (Alpes Maritimes), France

[21] Appl. No.: 198,094

[22] Filed: Oct. 17, 1980

Related U.S. Application Data

[62] Division of Ser. No. 60,517, Jul. 25, 1979, abandoned.

[30] Foreign Application Priority Data

Jul. 25, 1979 [FR] France ..... 79 10596

[51] Int. Cl.[3] ..... A65B 33/00

[52] U.S. Cl. ..... 427/4; 134/4; 427/155

[58] Field of Search ..... 134/4; 427/155, 4

[56] References Cited

U.S. PATENT DOCUMENTS 3,190,619 6/1965 Penny ..... 206/219
3,443,726 5/1969 Muller ..... 222/80
3,853,619 12/1974 Ged ..... 134/4

FOREIGN PATENT DOCUMENTS 2310069 9/1974 Fed. Rep. of Germany ..... 427/155

*Primary Examiner*—Sam Silverberg
*Attorney, Agent, or Firm*—Karl W. Flocks

[57] ABSTRACT

Device for stabilizing the texture of a plastic substance, notably animal excrements, in which said substance is coated in the plastic state with a fast-acting and non-toxic setting material forming a rigid foam of the polyurethane type from two separate constituents including a catalyst, said device being constituted by a container including two individual compartments for holding said two constituents, and a flow means for mixing said two constituents in situ, said flow means being integral or adaptable as a plug to said container and having two closable nozzles the inlets of which are respectively arranged in line with each of said two compartments, the respective capacities of said two compartments corresponding mutually in order to provide a coating which is suitable as to volume and speed of formation of said setting material.

1 Claim, 4 Drawing Figures

METHOD FOR STABILIZING THE TEXTURE OF A PLASTIC SUBSTANCE

This is a division of application Ser. No. 060,517, filed July 25, 1979 now abandoned.

BACKGROUND OF THE INVENTION

The present invention relates to a method of stabilizing the texture of a plastic substance, applicable notably for remedying the unpleasant or dangerous character of the presence of a slippery substance, in particular, animal excrements, on a pedestrian passageway. The invention also relates to means for applying this method.

It is known for example that the presence of animal excrements, notably from dogs, on a pavement or sidewalk, has, besides an unpleasant character since it is dirty and bad smelling, a dangerous character due to the fact of the plastic texture of the substance on which a pedestrian can accidentally slip.

SUMMARY OF THE INVENTION

It is therefore an object of the present invention to overcome these drawbacks by enabling the texture of the substance mentioned above to be modified in situ by stabilization.

In accordance with the invention, the substance is impregnated or coated in the plastic state with a fast-acting and non-toxic hardening or setting material by means of which the plastic substance is rendered inert and rigid or friable.

Under these conditions, the said substance rendered rigid or friable can easily be removed from the passageway, or else it no longer presents a slippery and consequently dangerous character.

For applying the above method, a fast-acting hardening material may have one or several of the properties mentioned below. It may be notably a drying, absorbent and/or coating material or again it may provide a reaction or decomposition product which itself combines with the constituents of the substance to give a final hardened and friable product.

The hardening material may of course be constituted by a mixture of materials with the properties mentioned above.

Among drying materials, it is possible to utilize the usual hydrophilic materials such as dehydrated calcium chloride and sulphate powders or liquids capable notably of forming an azeotrope more volatile than water.

Among absorbent materials, the usual porous solids such as clays may be applied.

Among coating materials may be mentioned synthetic resins notably of the polyester, epoxy and polyurethane type, in association with a sufficient amount of their appropriate catalyst to insure rapid setting. It is also possible to cite liquid polystyrene, giving a cellular foam which can itself produce a crust.

As a material giving a reaction product capable of combining with the constituents of the basic substance, may be mentioned mineral or preferably organic silicates such as ethyl orthosilicate whose decomposition forms powdery silica. The latter may then be combined or at least associated with the pre-existing binders in the basic substance which is still plastic to convert the plastic texture into a rigid and friable texture.

As mentioned above, the hardening or setting material must be preferably applied when the substance is in the plastic condition and for this purpose it must be packaged in order to permit easy transportation and use on a passageway. It is thus possible to envisage packaging in the form of a spray container with a pump or pressurized by a propellant gas, a mixer in the case of resins and their catalysts, or again, in the form of unit doses of explosive cartridges.

The applicant has in fact found that the hardening or setting material best adapted to this application is constituted by a rigid foam, for example, polyurethane formed in situ by means of its two separate components of which the catalyst is one, and has developed various applicator containers enabling easy use for a minimum cost price.

The present invention therefore provides such containers and their members designed to contain and to distribute suitably the two individual constituents of said material for the application of the method as defined above.

In accordance with the invention, a container comprises a flow device for the mixing of two constituents contained in two individual compartments forming an integral part of said container or adaptable to the latter.

According to a first embodiment, the flow device is constituted by a plug arranged in the neck of a container with two compartments and provided with two closable nozzles whose outlet orifices are arranged in the vicinity of one another, the inlet of said nozzles being respectively arranged in line with each of the two compartments.

In a second embodiment, the flow device is constituted by breakable tips of two ampoules, preferably coupled together containing respectively the two constituents.

In a third embodiment, the flow device is constituted by a single tip of a first individual compartment engaged and movable in a prolongation of a second compartment, the bottom of the first compartment as well as the upper part of the second compartment, arranged in the vicinity of one another, being separated by at least one tearable web, a web-perforating pin being inserted between them.

The first embodiment above may constitute an applicator member refillable by replacement of the two-compartment container with respect to the plug whilst the second and third embodiments constitute disposable unit doses.

Of course, the doses or respective capacities of the two compartments are such that they correspond mutually in order to provide a suitable foam as to volume and speed of formation and setting.

BRIEF DESCRIPTION OF THE DRAWINGS

Other characteristics and advantages of the invention will emerge better from the following description with reference to the accompanying drawings in which.

DESCRIPTION OF THE PREFERRED EMBODIMENTS

In general, it is known that the two constituents necessary for the formation of a polyurethane foam must be mixed at the very moment of use. Under these conditions, not only these two constituents must be preserved separately in individual compartments, but also arrangements must be provided in order to keep them with all safety without the inadvertent formation of foam manifested by considerable increase in volume and without the necessary nozzles clogging through the introduction of the constituent for which they are not assigned. Now these difficulties are overcome by means of the containers or applicators according to the invention.

Figure 1:
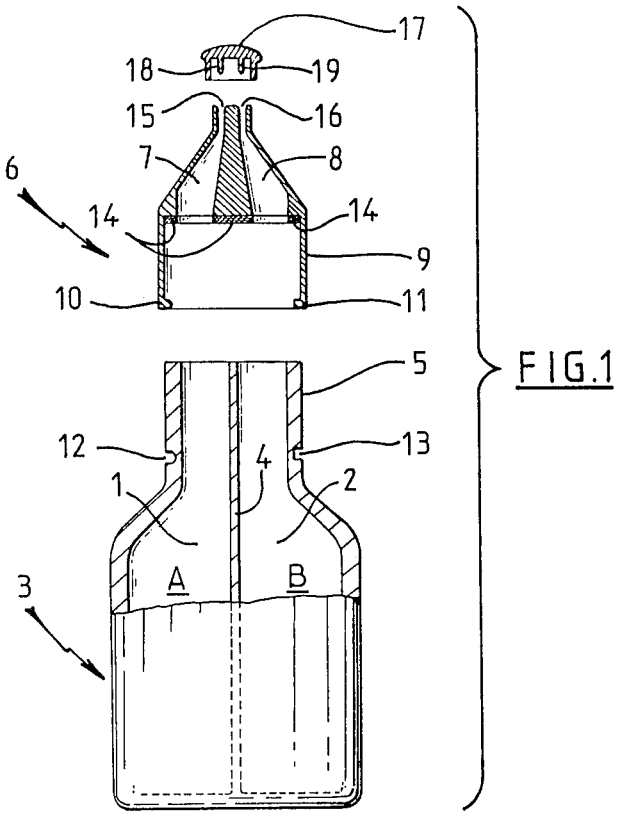
FIGS. 1 to 3 show respectively diagrammatic views of embodiments of containers or applicators according to the invention and FIG. 4 shows a view along the line IV—IV of FIG. 3.

Referring to FIG. 1, in a first embodiment, two individual compartments 1 and 2 enclose the respective constituents A and B. These two compartments may, for example, constitute a cylindrical bottle 3 provided with a separating partition 4 arranged in the plane parallel to the generators of the cylinder. The bottle 3 comprises a neck 5 also separated along the two compartments by the partition 4.

An applicator plug 6 may be fixed on the neck 5 and comprises two separate nozzles 7–8 which can be arranged in line with the respective compartments 1 and 2. To that purpose, plug 6 includes a skirt 9 adaptable on the body of neck 5 and whose lower end is provided with stubs 10 and 11 engageable in corresponding housings 12 and 13. In order to always maintain coincidence of the nozzles with respect to the compartments, the stub-recess assemblies constitute an "error-avoiding means," the stub 10 having, for example, a rounded shape corresponding to a recess 12, itself with a rounded cross-section, whilst stub 11 has, for example, a rectangular shape complementary to the recess 13. In this way, the plug 6 may be preserved and adapted to a container 3 itself replaceable. A seal 14 arranged at the base of the nozzles 7 and 8, insures in addition, the fluid-tightness of the plug with respect to the container and the fluid-tightness of the two nozzles 7 and 8 or of the two compartments 1 and 2 between themselves.

The nozzles 7 and 8 are terminated by two respective narrow portions 15 and 16 brought together and, for example, substantially parallel, themselves capable in their turn of being closed by a cover 17 with a suitable error-avoiding means provided with closure tips 18 and 19. Suitably, the container 3 may have a certain flexibility of its wall so as to facilitate by pressure the outflow of the two constituents A and B through the narrow portions 15 and 16 at the time of use.

Figure 2:
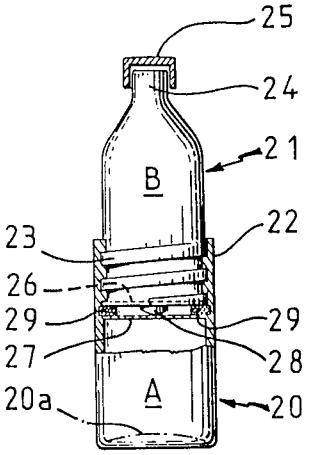

Referring to FIG. 2, in a second embodiment, an applicator container according to the invention may constitute a unit dose designed for single use and which can be disposed of after use, notably by coating itself at the same time as the excrement to be treated. This container is composed of two separate tubular compartments 20 and 21, the compartment 20 containing the constituent A being prolonged by a skirt 22 provided with a helicoidal ramp 23 cooperating with a complementary ramp formed on the lower part of the compartment 21 containing the constituent B. The latter compartment is provided with a nozzle 24 which can be capped by a cover 25.

The bottom 26 of the compartment 21, as well as the upper portion 27 of the compartment 20 are each constituted by a fluid-tight but tearable web, for example, a thin metal foil or a breakable plastic material, a perforating pin or perforator 28 being inserted between the two webs and, for example, fast to the web 26. A seal forming a flexible lip 29 is arranged between the lower portion of the compartment 21 and the upper portion of the upper compartment 20. For the utilization of the applicator container according to FIG. 2, it suffices to screw the compartment 21 into the skirt 22 by a fraction of a turn through the helicoidal ramp 23 which has the effect of bringing the perforator 28 to tear the webs 26 and 27 simultaneously to form the mixture of the constituents A and B which flow through the nozzle 24. This flow may also be facilitated by pressure exerted on the bottom **20*a*, provided of flexible material, of the compartment 20**.

Figure 3:
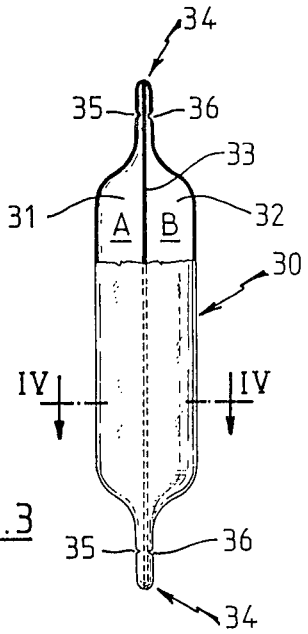
Figure 4:
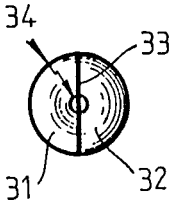

Referring to FIGS. 3 and 4, in a third embodiment, another unit dose in accordance with the invention can be constituted by a double ampoule 30 comprising a compartment 31 and a compartment 32, for example, with a semi-cylindrical cross-section of which the flat bottoms 33 are joined, as can be seen better in FIG. 4. Each compartment is extended by two tips 34 provided with a break initiator 35–36. In use, it suffices to break the tips 34 in order to ensure the simultaneous flow of the two constituents. Of course the double ampoule is formed of any suitable material such as glass or plastic material.

In all the above embodiments, it is obvious that the filling or capacity of the two separate compartments is such that mutual optimal proportioning is obtained so as to cause foaming and setting in a minimum time compatible with the use of the applicator.

It is also well understood that the present invention has only been described and illustrated by way of explanatory example which is to be regarded as in no way limiting and to which any useful modification may be applied, notably within the field of technical equivalents, without departing from its scope.

What is claimed is:

1. A method of rendering innocuous animal excrement, comprising providing a container including first and second individual compartments for respectively holding first and second constituents of a fast-acting and non-toxic polyurethane rigid foam setting material, and setting material discharge means comprising a discharge tip forming an intergral part of said first individual compartment of said container, said first and second compartments being tubular and mutually engaged through a helicoidal ramp; a first puncturable web at the bottom of said first compartment; a second puncturable web at the upper part of said second compartment; and web-perforating means between said first and second compartments whereby said two compartments are independent and fluid-tight and said web-perforating means simultaneously tears said first and second webs when said two compartments are screwed together through said helicoidal ramp;

screwing said two compartments together to effect tearing of said first and second webs and mixing of the two separate constituents and formation of polyurethane foam;

applying the discharge tip of said device adjacent the animal excrement; and coating the animal excrement with polyurethane foam from said device.

* * * * *